US006664868B1

(12) United States Patent
Echols, Jr.

(10) Patent No.: US 6,664,868 B1
(45) Date of Patent: Dec. 16, 2003

(54) SHIM-TUNED COAXIAL CABLE IMPEDANCE TRANSFORMER

(75) Inventor: Billy G. Echols, Jr., Jackson, MS (US)

(73) Assignee: WorldCom, Inc., Clinton, MS (US)

( * ) Notice: Subject to any disclaimer, the term of this patent is extended or adjusted under 35 U.S.C. 154(b) by 0 days.

(21) Appl. No.: 10/025,394

(22) Filed: Dec. 19, 2001

(51) Int. Cl.[7] ..... H01P 5/04
(52) U.S. Cl. ..... 333/33; 333/263
(58) Field of Search ..... 333/33, 35, 263

(56) References Cited

U.S. PATENT DOCUMENTS 2,900,610 A * 8/1959 Allen et al. ..... 333/263 X
3,340,485 A * 9/1967 Caron ..... 333/224
3,792,385 A * 2/1974 Napoli et al. ..... 333/224
5,545,949 A * 8/1996 Bacher ..... 315/39

* cited by examiner

*Primary Examiner*—Robert Pascal
*Assistant Examiner*—Stephens E. Jones

(57) ABSTRACT

A shim-tuned transformer for matching the impedance of a generator and a load coupled to the generator via a transmission line. The transformer includes an outer conductor having an inner surface and an inner conductor positioned within the outer conductor. The transformer further includes at least one shim disposed on the inner surface of the outer conductor and encircling the inner conductor. The at least one shim is slideable along the inner surface of the outer conductor for matching the impedance of the generator and the impedance of the load.

21 Claims, 5 Drawing Sheets

Sideview of shim-tuned coaxial transformer with slot on top. Shown after tuning with pressed-in shields.

SHIM-TUNED COAXIAL CABLE IMPEDANCE TRANSFORMER

BACKGROUND OF THE INVENTION

1. Field of the Invention

This invention relates generally to impedance matching transformers and, more particularly, to a shim-tuned coaxial cable impedance transformer.

2. Description of the Related Art

A generator, such as a transmitter, for example, is typically designed to operate into a specific impedance of a network. However, a load (e.g., an antenna) that is coupled to the generator usually does not provide the specific impedance in which the generator is designed to operate.

When the impedance of the load and the impedance as seen by the generator are equal, maximum power is transferred from the generator to the load over a transmission line coupling the generator to the load. If a mismatch between the impedances of the load and generator occurs, however, the power that is not transferred to the load may be returned towards the generator through the transmission line. These rearward-traveling waves may combine with their respective forward-traveling waves along the transmission line, and because of the phase differences along various positions within the line, may cause standing waves in the transmission line by the alternate cancellation and reinforcement of the voltage and current distributed along the transmission line. The larger the standing waves that occur along the transmission line, the greater the mismatch of the impedance of the load that is coupled to the generator.

In an attempt to compensate for this impedance mismatch between the generator and the load, series-tuned transformers, such as slug-tuned transformers, for example, have been used. These particular transformers, however, have been historically difficult to accurately construct and calibrate, thus resulting in a very limited improvement, if any, in impedance matching a generator to a load. Slug-tuned transformers are typically problematic because relatively large frequency shifts make it very difficult to match high standing wave ratio (SWR) values of the transmission line. Additionally, the slugs within the slug-tuned transformers cannot be changed or adjusted within the transformer without disassembly of the transformer. Accordingly, the slug-tuned transformer is difficult to calibrate as a result of the need to disassemble the transformer to replace and/or adjust the slugs.

The present invention is directed to overcoming, or at least reducing the effects of, one or more of the problems set forth above.

SUMMARY OF THE INVENTION

One aspect of the present invention is seen in a transformer for matching the impedance of a generator and a load coupled to the generator via a transmission line. The transformer includes an outer conductor having an inner surface and an inner conductor positioned within the outer conductor. The transformer further includes at least one shim disposed on the inner surface of the outer conductor and encircling the inner conductor. The at least one shim is slideable along the inner surface of the outer conductor for matching the impedance of the generator and the impedance of the load.

Another aspect of the present invention is seen in a system. The system comprises a generator for generating a signal and a load for receiving the signal generated by the generator. The system further includes a transformer coupled between the generator and the load. The transformer includes an outer conductor having an inner surface and an inner conductor positioned within the outer conductor. The transformer further includes at least one shim disposed on the inner surface of the outer conductor and encircling the inner conductor. The at least one shim is slideable along the inner surface of the outer conductor for matching the impedance of the generator and the impedance of the load.

Another aspect of the present invention is seen in a method for matching the impedance of a generator to a load coupled to the generator via a transmission line. The method comprises providing an outer conductor having an inner surface and providing an inner conductor positioned within the outer conductor. The method further comprises providing at least one shim disposed on the inner surface of the outer conductor and encircling the inner conductor, the at least one shim being slideable along the inner surface of the outer conductor for matching the impedance of the generator and the impedance of the load.

BRIEF DESCRIPTION OF THE DRAWINGS

The invention may be understood by reference to the following description taken in conjunction with the accompanying drawings, in which like reference numerals identify like elements, and in which.

Figure 1:
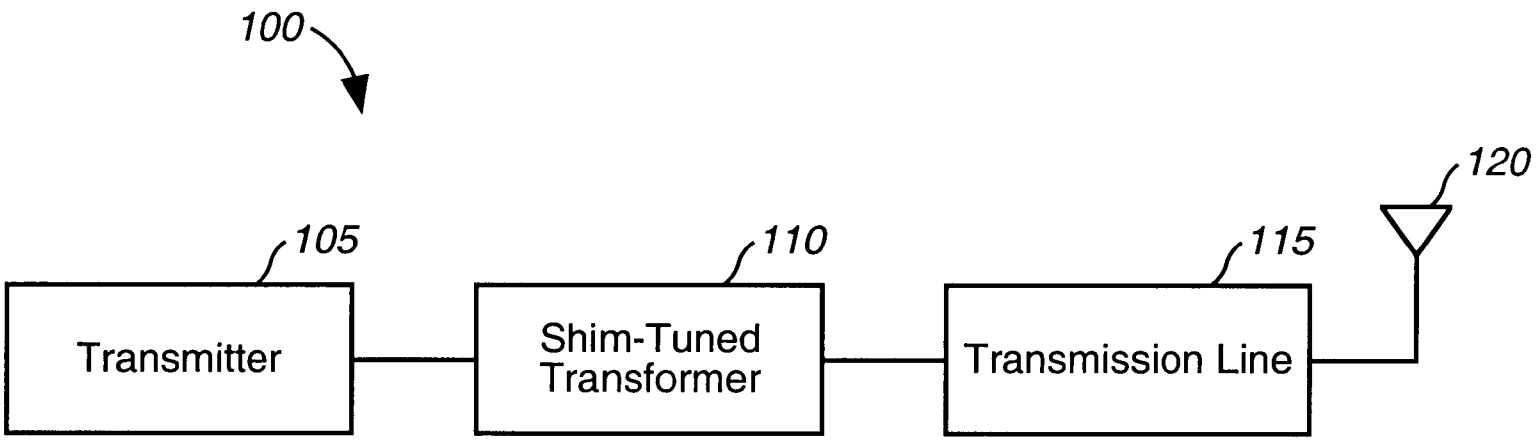
FIG. 1 shows a simplified block diagram of a wireless transmission network, including a shim-tuned transformer for impedance matching a transmitter to an antenna in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and specifically referring to FIG. 1, a simplified block diagram of a transmission network 100, employing a shim-tuned transformer, is shown in accordance with one embodiment of the present invention. In the illustrated embodiment, the transmission network 100 may be used for a variety of wireless applications including, but not necessarily limited to, AM, FM, SSB, TV, satellite, cellular, and PCS communications. In addition to the aforementioned examples, it will be appreciated that the transmission network 100 may operate in accordance with various other wireless transmission protocols without departing from the spirit and scope of the present invention. It will further be appreciated that the transmission network 100 may alternatively take the form of a receiving network for receiving signals either in addition to or in lieu of transmitting signals.

In one embodiment of the present invention, the transmission network 100, in one of its simplest forms, comprises a transmitter 105 for generating signals, a transmission line 115 for carrying the signals generated by the transmitter 105, and an antenna 120 for sending the signals generated by the transmitter 105 via a wireless communication medium to a receiver station (not shown). Although the network 100 of FIG. 1 is provided in the form of a transmission network, its application is not so limited. It will be appreciated that the transmitter 105 may take the form of any type of signal generator and the antenna 120 may take the form of any type of load. Accordingly, the transmission network 100 illustrated in FIG. 1 need not necessarily be limited to a wireless transmission network, but may take on a variety of other forms where the need for impedance matching a signal generator to a load is desirable.

In accordance with one embodiment of the present invention, the transmission line 115 that couples the transmitter 105 to the antenna 120 is provided in the form of a coaxial cable, such as RG8A coaxial cable, for example. It will be appreciated, however, that the transmission line 115 may include various other types of known transmission lines in lieu of a coaxial cable without departing from the spirit and scope of the present invention.

When the load impedance of the antenna 120 (i.e., the load) and the characteristic impedance $Z_0$ (as seen from the transmitter 105) are equal, maximum power is transferred via the transmission line 115 to the antenna 120. If a mismatch of these impedances occurs, however, the power that is not transferred via the transmission line 115 to the antenna 120 may be returned towards the transmitter 105. These rearward-traveling waves may combine with their respective forward-traveling waves on the transmission line 115, and because of the phase differences along various positions within the transmission line 115, may cause standing waves in the transmission line 115 by the alternate cancellation and reinforcement of the voltage and current distributed along the transmission line 115.

To compensate for the impedance mismatch of the transmitter 105 and the antenna 120 that may occur, the transmission network 100 is provided with a shim-tuned transformer 110. In accordance with the illustrated embodiment, the shim-tuned transformer 110 substantially matches the characteristic impedance as seen from the transmitter 105 to the load impedance of the antenna 120 to maximize the power that is transferred from the transmitter 105 to the antenna 120 via the transmission line 115.

Figure 2:
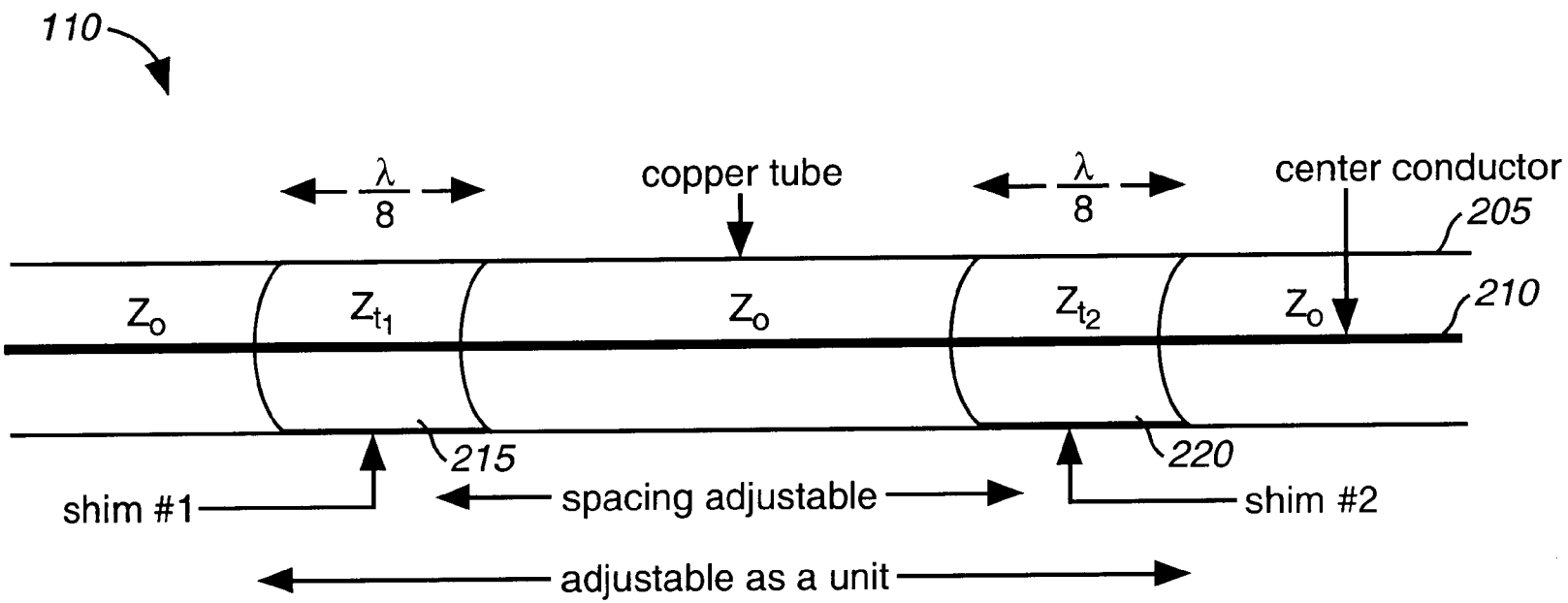
FIG. 2 illustrates a more detailed representation the shim-tuned impedance matching transformer of FIG. 1.

Turning now to FIG. 2, a more detailed representation of the shim-tuned transformer 110 is shown in accordance with one embodiment of the present invention. The transformer 110 comprises an outer conductor 205 and a center conductor 210 that is disposed lengthwise within the outer conductor 205. In the illustrated embodiment, the outer conductor 205 takes the form of a copper tube. It will be appreciated, however, that the outer conductor 205 may be constructed out of other suitable conductive materials, as opposed to copper, without departing from the spirit and scope of the present invention. According to one embodiment of the present invention, the outer conductor 205 is provided with an elongated opening or slot (not viewable in FIG. 2) that runs lengthwise along the top surface of the outer conductor 205. The functionality of this slot formed on the outer conductor 205 will be appreciated as the description proceeds.

Figure 3C:
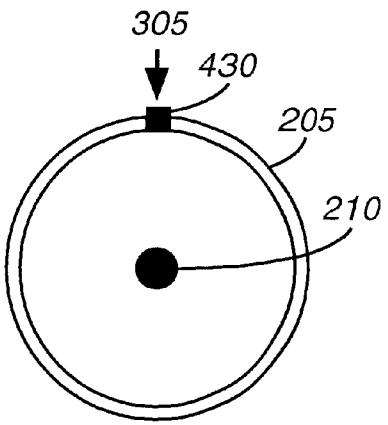
FIGS. 3A–C provide a cross-sectional view of portions of the shim-tuned impedance matching transformer of FIG. 2 according to one embodiment of the present invention.
Figure 3B:
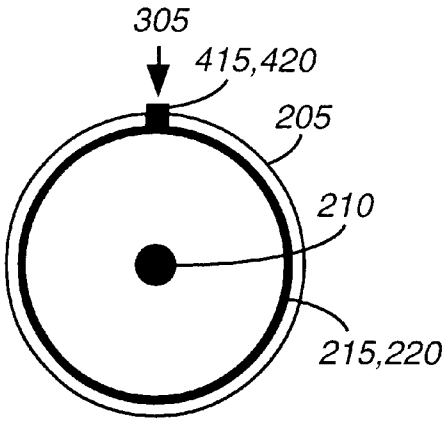
Figure 3A:
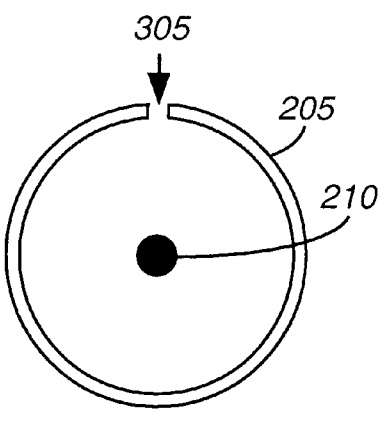

Referring now to FIG. 3A, a cross-sectional view of a portion of the shim-tuned transformer 110 is provided. The outer conductor 205 encircles the center conductor 210, and a slot 305 is formed therein lengthwise along the top surface of the outer conductor 205 so as to provide an elongated opening between the inside and outside of the outer conductor 205.

Figure 3D:
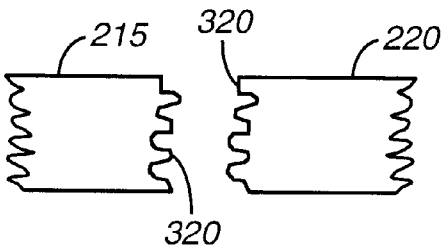
FIG. 3D provides a detailed representation of the shims of the impedance matching transformer of FIG. 2 incorporating mating teeth formed on the edges of the shims for combining the shims with one another.

Referring back to FIG. 2, the transformer 110 comprises a pair of shims 215, 220, in accordance with one embodiment, that are moveably disposed on the inner surface of the outer conductor 205. The shims 215, 220 (as illustrated in FIG. 2) are viewed as if one could see through the outer conductor 205; although in reality, the shims 215, 220 reside on the inner surface of the outer conductor 205 and are not viewable from the outside surface of the outer conductor 205. Although two shims 215, 220 are illustrated in FIG. 2, it will be appreciated that the number of shims 215, 220 disposed on the inner surface of the outer conductor 205 may vary. For example, the transformer 110 may include three, four, or more shims 215, 220 disposed on the inner surface of the outer conductor 205 without departing from the spirit and scope of the present invention. In an alternative embodiment, the shims 215, 220 may be configured with mating teeth 320 (FIG. 3D) on each mating end of the shims 215, 220 such that the shims 215, 220 may be joined in a "locking" relationship so as to form one shim 215, 220 using various standard shim lengths. It will further be appreciated that the shims 215, 220 may be joined using other types of mating mechanisms, as opposed to the mating teeth herein described, without departing from the spirit and scope of the present invention.

The spacing between the shims 215, 220 is adjustable, along the outer conductor 205 to substantially match the characteristic impedance as seen by the transmitter 105 and the load impedance of the antenna 120 of the transmission network 100. Once the proper spacing between the shims 215, 220 is set, the shims 215, 220 may then be moved as a unit along the outer conductor 205 to substantially match the impedances. Accordingly, both the spacing between the shims 215, 220 and their location along the outer conductor 205 are adjustable.

Referring to FIG. 3B, a cross-sectional view of a portion of the transformer 110 is shown where at least one of the shims 215, 220 is disposed therein. In the illustrated embodiment, the shim 215, 220 takes the form of a cylindrical shape and is disposed on the inner surface of the outer conductor 205 so as to encircle the center conductor 210.

Figure 4:
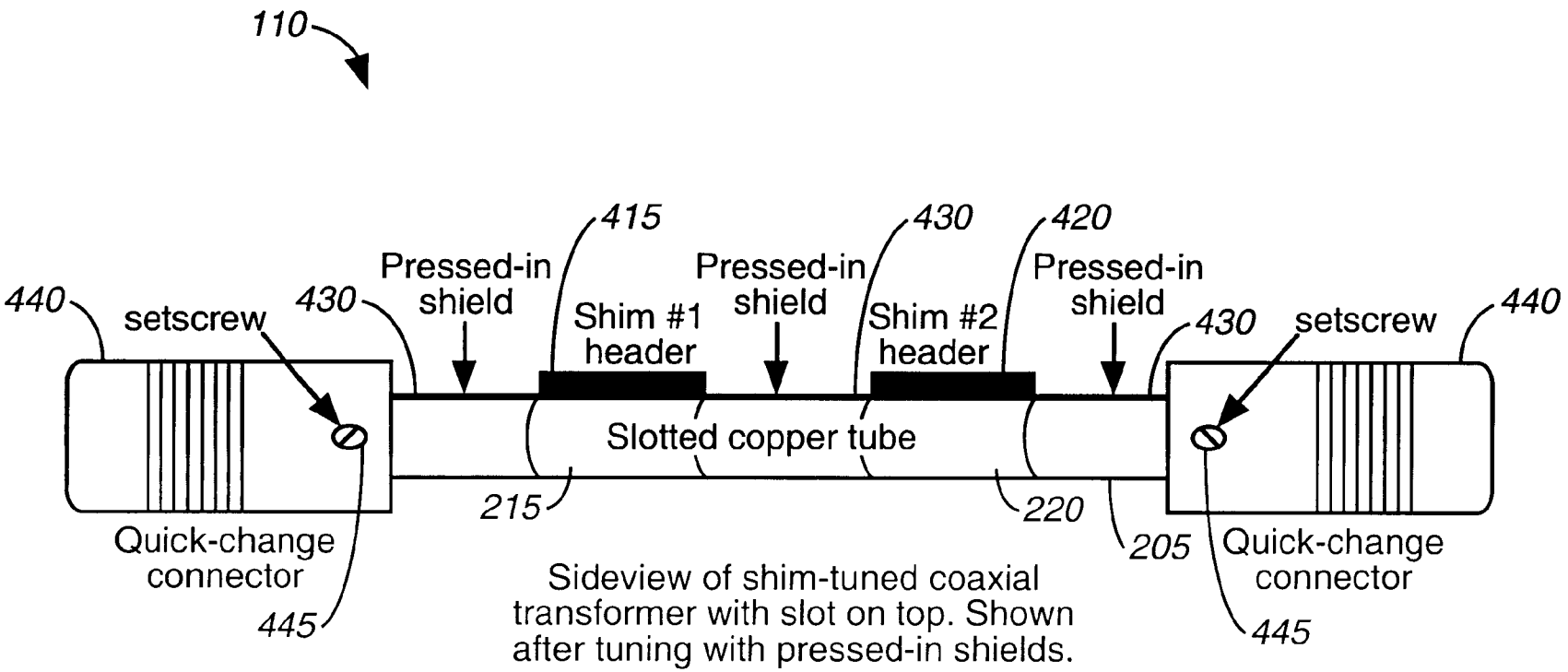
FIG. 4 provides a cross-sectional view of the shim-tuned impedance matching transformer of FIG. 2 according to one embodiment of the present invention.

Turning now to FIG. 4, a side view perspective of the shim-tuned transformer 110 is shown in accordance with one embodiment of the present invention. The shims 215, 220 disposed on the inner surface of the outer conductor 205 respectively include header tabs 415, 420 that rise through the slot 305 that runs lengthwise along the top of the outer conductor 205. The header tabs 415, 420 permit the shims 215, 220 to be moved along the inside surface of the outer conductor 205 by sliding their respective header tabs 415, 420 along the slot 305 that runs along the top of the outer conductor 205. A cross-sectional perspective view of the header tabs 415, 420 are shown in FIG. 3B, protruding from the slot 305 of the outer conductor 205.

The header tabs 415, 420 permit movement of the shims 215, 220 within the outer conductor 205 to calibrate the transformer 110 to match the characteristic impedance and the load impedance of the antenna 120 without the inconvenience of disassembling the transformer 110. In accordance with one embodiment, the movement of the header tabs 415, 420 may be performed by human interaction. Alternatively, the transformer 110 may be configured with a motor-driven mechanism (not shown) to move the header tabs 415, 420 of the transformer 110.

According to one embodiment of the present invention, a thin coat of polytetrafluroethylene (PTFE) may be applied to the inner surface of the outer conductor 205 to facilitate movement of the shims 215, 220 along the inner surface of the outer conductor 205. PTFE is commercially made available by Dupont as Teflon®. It will be appreciated, however, that other types of coating materials that are suitable for facilitating the movement of the shims 215, 220 within the outer conductor 205 may be used in lieu of PTFE without departing from the spirit and scope of the present invention.

Referring again to FIG. 4, once the proper spacing of the shims 215, 220 is determined, a pre-sprung shielding material 430 may be placed within the slot 305 of the outer conductor 205 to prevent the header tabs 415, 420, and their respective shims 215, 220, from shifting within the outer conductor 205 of the transformer 110. Referring to FIG. 3C, a cross-sectional view of a portion of the transformer 110 is shown. The shielding material 430 is pressed into the slot 305 of the outer conductor 205 to substantially prevent the shim header tabs 415, 420 of their respective shims 215, 220 from shifting within the slot 305 of the outer conductor 205 once the transformer 110 is calibrated for optimal impedance matching.

When it is desired to adjust the spacing of the shims 215, 220 within the transformer 110, the shielding material 430 may be removed from the slot 305 of the outer conductor 205. Subsequent to removing the shielding material 430 from the slot 305, the spacing of the shims 215, 220 may then be adjusted by sliding the shim header tabs 415, 420 along the slot 305 of the outer conductor 205. When the desired position of the shims 215, 220 is achieved by moving their respective shim header tabs 415, 420 along the slot 305 of the outer conductor 205, the shielding material 430 may then be pressed into the remaining gaps of the slot 305 (i.e., the gaps in the slot 305 adjacent the shim header tabs 415, 420) to prevent the shims 215, 220 from shifting within the outer conductor 205 of the transformer 110 once calibrated.

According to one embodiment, the transformer 110 is further provided with connectors 440 on each end of the outer conductor 205 to permit connection of the transformer to the transmission line 115 of the transmission network 100. In one embodiment, the connectors 440 are of the quick-change type, and the connectors 440 are fastened to the outer conductor 205 of the transformer 110 by set screws 445. It will be appreciated, however, that the type of connectors 440 used for coupling the transformer 110 to the transmission line 115 and the manner in which the connectors 440 are fastened to the outer conductor 205 may vary without departing from the spirit and scope of the present invention.

In accordance with one embodiment of the present invention, the overall length of the shim-tuned transformer 110 is the sum of one-half the wavelength needed for phase adjustments, the optimum distance between the shims 215, 220, and the combined length of the shims 215, 220. Adjustments may be made with conventional impedance matching instruments such as watt meters, impedance bridges, and the like. By shortening the overall length of the outer conductor 205, the length of the shims 215, 220, and reducing the spacing between the shims 215, 220 may widen the bandwidth of the shim-tuned transformer 110. This will, of course, limit the standing wave ratio (SWR) reducible to unity. The lengths of the shims 215, 220 may be cut shorter by a factor of $1/(\epsilon)^{1/2}$, where $\epsilon$ is the velocity factor, to compensate for the slower speed of the electrons through the transformer dielectric in comparison to the speed of the electrons in air. For example, $\epsilon$ is typically measured at 0.66 for a transmission line 115 including RG8A coaxial cable.

Several different characteristic impedances may be produced for the transmission network 100 using the shim-tuned transformer 110 by varying the thickness of the shims 215, 220. For example, a shim gauge of 15 is 0.0673 inches thick. When the shims 215, 220 (using gauge 15) are inserted within the outer conductor 205 having an outer diameter of 0.5 in., it reduces the inside diameter of the outer conductor 205 and produces a shim impedance ($z_t$) of 40.69 Ω and a characteristic impedance $Z_t$ of 0.814. Alternatively, a shim gauge of 7 is 0.1793 inches thick, and when the shim 215, 220 (using gauge 7) is inserted within the outer conductor 205 it reduces the inside diameter of the outer conductor 205 by producing a shim impedance ($z_t$) of 21.17 Ω and a characteristic impedance $Z_t$ of 0.423. From these examples, it will be appreciated that the impedance may be altered by using different thicknesses of the shims 215, 220, inner diameters of the outer conductor 205, and inner wire gauges for the center conductor 210.

In one embodiment of the present invention, the shim-tuned transformer 110 having a length of 1.25 wavelengths with the shims 215, 220 having a total of one-fourth wavelengths (i.e., one-eighth wavelengths each) and having a ratio of shim impedance ($z_t$) to a characteristic impedance ($Z_0$) of 0.4 can match a transmission line 115 having a 40:1 voltage SWR. The minimum SWR occurs when the two shims 215, 220 are placed within the outer conductor 205 such that the spacing between them are conjugate and the shims 215, 220 are adjusted as a unit over the 1.25 wavelength distance of the shim-tuned transformer 110.

Figure 5:
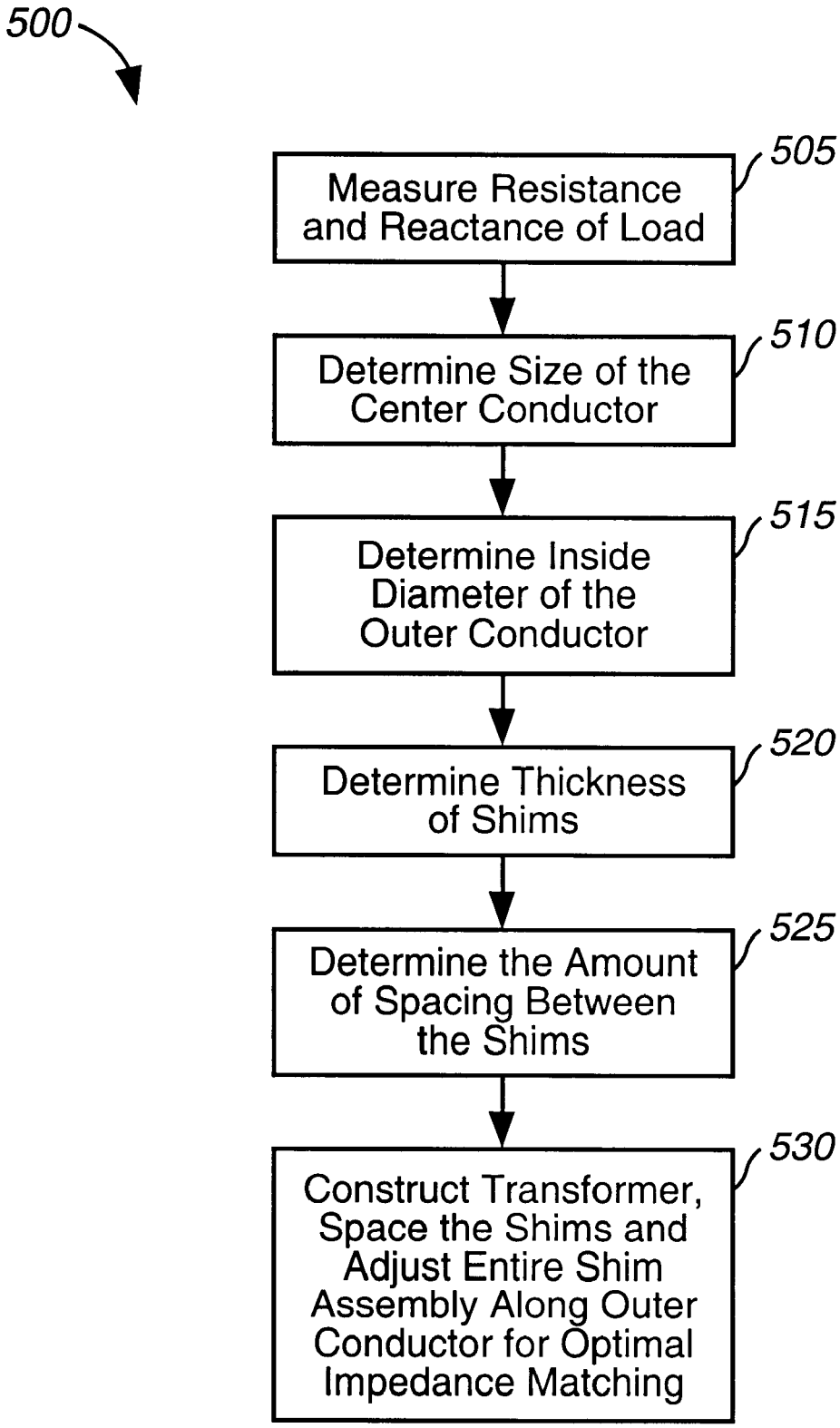
FIG. 5 illustrates a process for designing the shim-tuned impedance transformer of FIG. 2 according to one embodiment of the present invention.

Turning now to FIG. 5, a process 500 for designing the shim-tuned transformer 110 is provided in accordance with one embodiment of the present invention. The process 500 commences at block 505 where the resistance and the reactance of the antenna 120 is determined. According to one embodiment, the resistance and reactance of the antenna 120 may be calculated with a Numerical Electromagnetic Code method of moments antenna-modeling tool such as EZNEC 3.0, which is available by EZNEC Antenna Software, Beaverton, Oreg. At block 510, the size of the center conductor 210 is determined to match the output impedance of the transmitter 105. In the illustrated embodiment, the size of the center conductor 210 is selected based upon the current handling requirements at the RF frequency in which the transmitter 105 is tuned.

The process 500 continues at block 515 where the inside diameter of the outer conductor 205 is determined from the gauge size used for the outer conductor 205. At block 520, the thickness of the shims 215, 220 are determined based upon the outer diameter of the outer conductor 205.

At block 525, the amount of spacing between the shims 215, 220 is calculated using a Smith Chart® or Smith software, such as WinSmith®, available from Nobel Publishing Company, Atlanta, Ga. The transformer 110 is then constructed at block 530 and the spacing between the shims 215, 220 and the location of the shim assembly along the outer conductor 205 is adjusted for optimal impedance matching between the transmitter 105 and the antenna 120.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A transformer for matching the impedance of a generator and a load coupled to the generator via a transmission line, comprising:

an outer conductor having an inner surface;

an inner conductor positioned within the outer conductor;

a plurality of shims disposed on the inner surface of the outer conductor and encircling the inner conductor, the shims being slideable along the inner surface of the outer conductor for matching the impedance of the generator and the impedance of the load; and a coating material applied to the inner surface of the outer conductor to facilitate the sliding of the shims along the inner surface of the outer conductor.

2. The transformer of claim 1, wherein the coating material applied to the inner surface of the outer conductor comprises polytetrafluroethylene.

3. A transformer for matching the impedance of a generator and a load coupled to the generator via a transmission line, comprising:

an outer conductor having an inner surface and an outer surface, the outer conductor having a slot formed lengthwise along the outer surface of the outer conductor, the slot providing an opening between the inner and outer surfaces of the outer conductor;

an inner conductor positioned within the outer conductor; and a plurality of shims disposed on the inner surface of the outer conductor and encircling the inner conductor, the shims being slideable along the inner surface of the outer conductor for matching the impedance of the generator and the impedance of the load, the shims include including a pair of shims each including a respective header tab attached thereto and protruding through the slot formed within the outer conductor, the edges of the pair of shims including mating teeth for mating the pair of shims together by a locking relationship of their respective mating teeth by movement of their respective header tabs towards one another.

4. A transformer for matching the impedance of a generator and a load coupled to the generator via a transmission line, comprising:

an outer conductor having an inner surface and an outer surface, the outer conductor having a slot formed lengthwise along the outer surface of the outer conductor, the slot providing an opening between the inner and outer surfaces of the outer conductor;

an inner conductor positioned within the outer conductor; and a plurality of shims disposed on the inner surface of the outer conductor and encircling the inner conductor, the shims being slideable along the inner surface of the outer conductor for matching the impedance of the generator and the impedance of the load, the shims including a header tab attached thereto that extends through the slot of the outer conductor, movement of the header tab along the slot formed in the outer conductor causing the shim attached thereto to slide along the inner surface of the outer conductor, movement of the header tab being restricted by a shielding material placed within the slot of the outer conductor adjacent the header tab.

5. The transformer of claim 4, further comprising a connector attached to each end of the outer conductor, wherein the connector couples the transformer to the transmission line between the generator and the load.

6. The transformer of claim 4, wherein a spacing between the shims and a position of the shims relative to the outer conductor are adjustable for matching the impedance of the generator and the impedance of the load.

7. The transformer of claim 4, wherein the shims are separately slideable along the inner surface of the outer conductor.

8. The transformer of claim 4, wherein the outer conductor and inner conductor of the transformer form a coaxial cable.

9. The transformer of claim 4, wherein the generator is a transmitter and the load is an antenna.

10. A system comprising:

a generator for generating a signal;

a load for receiving the signal generated by the generator; and a transformer coupled between the generator and the load, the transformer including:

an outer conductor having an inner surface and an outer surface, the outer conductor having a slot formed lengthwise along the outer surface of the outer conductor, the slot providing an opening between the inner and outer surfaces of the outer conductor;

an inner conductor positioned within the outer conductor; and a plurality of shims disposed on the inner surface of the outer conductor and encircling the inner conductor, the shims being slideable along the inner surface of the outer conductor for matching the impedance of the generator and the impedance of the load, the shims including a pair of shims each including a respective header tab attached thereto and protruding through the slot formed within the outer conductor, the edges of the pair of shims including mating teeth for mating the pair of shims together by a locking relationship of their respective mating teeth by movement of their respective header tabs towards one another.

11. A system, comprising:

a generator for generating a signal;

a load for receiving the signal generated by the generator; and a transformer coupled between the generator and the load, the transformer including:

an outer conductor having an inner surface and an outer surface, the outer conductor having a slot formed lengthwise along the outer surface of the outer conductor, the slot providing an opening between the inner and outer surfaces of the outer conductor;

an inner conductor positioned within the outer conductor; and a plurality of shims disposed on the inner surface of the outer conductor and encircling the inner conductor, the shims being slideable along the inner surface of the outer conductor for matching the impedance of the generator and the impedance of the load, the shims including a header tab attached thereto that extends through the slot of the outer conductor, movement of the header tab along the slot formed in the outer conductor causing the shim attached thereto to slide along the inner surface of the outer conductor, movement of the header tab being restricted by a shielding material placed within the slot of the outer conductor adjacent the header tab.

12. The system of claim 11, wherein the transformer further comprises a connector attached to each end of the outer conductor, wherein the connector couples the transformer to the transmission line between the generator and the load.

13. The system of claim 11, wherein the system comprises a wireless transmission system and the generator includes a transmitter and the load includes an antenna.

14. The system of claim 11, wherein the outer conductor and inner conductor of the transformer form a coaxial cable.

15. The system of claim 11, wherein the shims are separately slideable along the inner surface of the outer conductor.

16. The system of claim 11, wherein a spacing between the shims and a position of the shims relative to the outer conductor are adjustable for matching the impedance of the generator and the impedance of the load.

17. A system, comprising:

a generator for generating a signal;

a load for receiving the signal generated by the generator; and a transformer coupled between the generator and the load, the transformer including:

an outer conductor having an inner surface;

an inner conductor positioned within the outer conductor; and a plurality of shims disposed on the inner surface of the outer conductor and encircling the inner conductor, the shims being slideable along the inner surface of the outer conductor for matching the impedance of the generator and the impedance of the load; and a coating material applied to the inner surface of the outer conductor to facilitate the sliding of the shims along the inner surface of the outer conductor.

18. The system of claim 17, wherein the coating material applied to the inner surface of the outer conductor comprises polytetrafluroethylene.

19. A method for matching the impedance of a generator to a load coupled to the generator via a transmission line, comprising:

providing an outer conductor having an inner surface and an outer surface;

forming a slot lengthwise along the outer surface of the outer conductor, the slot providing an opening between the inner and outer surfaces of the outer conductor;

providing an inner conductor positioned within the outer conductor; and providing a plurality of shims disposed on the inner surface of the outer conductor and encircling the inner conductor, the shims being slideable along the inner surface of the outer conductor for matching the impedance of the generator and the impedance of the load, the shims including header tabs attached thereto that extend through the slot of the outer conductor, movement of the header tabs along the slot formed in the outer conductor causing the shims attached thereto to slide along the inner surface of the outer conductor movement of the header tabs being restricted by a shielding material placed within the slot of the outer conductor adjacent the header tabs.

20. The method of claim 19, further comprising:

moving the shims relative to each other.

21. The method of claim 19, further comprising:

adjusting a spacing between the shims and a position of the shims relative to the outer conductor for matching the impedance of the generator and the impedance of the load.

* * * * *